US012807277B2

(12) United States Patent
Bestul et al.

(10) Patent No.: US 12,807,277 B2
(45) Date of Patent: Nov. 24, 2026

(54) PONTOON BOAT DOOR ASSEMBLY AND METHOD OF USE

(71) Applicant: FOREST RIVER, INC., Elkhart, IN (US)

(72) Inventors: Kevin Bestul, Union, MI (US); Todd W. Moore, Apple Valley, MN (US)

(73) Assignee: FOREST RIVER, INC., Elkhart, IN (US)

( * ) Notice: Subject to any disclaimer, the term of this patent is extended or adjusted under 35 U.S.C. 154(b) by 203 days.

(21) Appl. No.: 18/793,345

(22) Filed: Aug. 2, 2024

(65) Prior Publication Data

US 2025/0050976 A1 Feb. 13, 2025

Related U.S. Application Data

(60) Provisional application No. 63/531,139, filed on Aug. 7, 2023.

(51) Int. Cl.
*B63B 19/08* (2006.01)
*B63B 35/34* (2006.01)

(52) U.S. Cl.
CPC ..... *B63B 19/08* (2013.01); *B63B 35/34* (2013.01)

(58) Field of Classification Search
CPC ..... B63B 19/00; B63B 19/08; B63B 25/00; B63B 35/34; B63B 2019/0053; B63B 2019/0069; E06B 11/022; E06B 11/025; E05C 1/004; E05C 1/006; E05C 1/08; E05C 1/085; E05C 1/12; E05C 1/16; E05C 1/166; E05C 19/001; E05C 19/003; E05C 19/004; E05C 7/04; E05C 7/045; E05C 17/44; E05C 17/446; E05C 17/46; E05C 17/48; Y10S 292/15
See application file for complete search history.

(56) References Cited

U.S. PATENT DOCUMENTS

| | | | | |
|---|---|---|---|---|
| 595,505 | A * | 12/1897 | Wesling | E05C 17/446 109/60 |
| 10,415,290 | B1 * | 9/2019 | Flannery | E06B 7/32 |
| 12,358,595 | B2 * | 7/2025 | Fishburn | B63B 19/08 |
| 12,617,499 | B2 * | 5/2026 | Pruszynski | B63B 35/34 |
| 2022/0411022 | A1 * | 12/2022 | Fishburn | B63B 1/125 |
| 2024/0017799 | A1 * | 1/2024 | Pruszynski | B63B 35/34 |
| 2025/0319946 | A1 * | 10/2025 | Fishburn | B63B 3/48 |

* cited by examiner

*Primary Examiner* — Philip J Bonzell
(74) *Attorney, Agent, or Firm* — Taft Stettinius & Hollister LLP; Stephen F. Rost

(57) ABSTRACT

A pontoon boat includes a deck and an interior of the pontoon boat that is located on the deck. The interior of the pontoon boat includes seating for passengers of the pontoon boat. The pontoon boat includes a door movable between a closed position that blocks access to the interior and an open position that facilitates access to the interior. The door includes a door frame and a release assembly movable vertically relative to the door frame from an upper position to a lower position, and the release assembly is positioned at least partially within the door frame. When the release assembly is in the lower position and the door is in the closed position the door is not movable to the open position.

16 Claims, 7 Drawing Sheets

PONTOON BOAT DOOR ASSEMBLY AND METHOD OF USE

RELATED APPLICATIONS

This application claims the benefit of U.S. Provisional Patent Application Ser. No. 63/531,139, filed Aug. 7, 2023, the disclosure of which is hereby incorporated by reference in its entirety.

FIELD OF THE DISCLOSURE

The present disclosure relates to a pontoon boat, and more particularly to a door assembly of a pontoon boat.

BACKGROUND

Pontoon boats are popular recreational watercraft that are desirable due to their ability to carry many passengers and to provide adequate seating for those passengers. Pontoon boats may include decks and frames, which include walls extending upwardly from the decks. Some pontoon boats include doors that cooperate with the frames to block and facilitate access by passengers to the interior of the pontoon boats where the seating is located. Such doors are often difficult to open and close, especially when a user of the door has only one hand available to operate the door. Other doors fail to remain closed due to inadequate latching mechanisms.

SUMMARY

In an illustrative embodiment, a pontoon boat comprises: a frame including a first wall and a second wall spaced apart from the first wall; a door movable between a closed position in which the door is aligned with the first wall and the second wall and an open position in which the door is not aligned with the first wall and the second wall, the door including a door frame; a deck relative to which the door is pivotable, the deck supporting the frame; a stopper fixedly coupled to the deck and configured to receive the door in the closed position; wherein the door further includes a release assembly positioned at least partially within the door frame and movable vertically relative to the door frame from an upper position to a lower position; and wherein when the release assembly is in the lower position and the door is in the closed position the door is not movable to the open position.

In one example of this embodiment, the door frame includes at least a first pole and a second pole, the first and second poles being oriented at an angle relative to one another; wherein the first and second poles define a cavity in which the release assembly moves in and out of as the door moves between the open and closed positions. In a second example, the second pole is oriented in a generally vertical orientation relative to the deck, the second pole being hollow and configured to receive a rod; wherein the rod is coupled to the release assembly for movement in a generally vertical direction as the release assembly is moved relative to the door frame.

In a third example, the rod is coupled to the release assembly via a threaded nut. In a fourth example, the release assembly includes a handle; a rod coupled to the handle via a threaded nut, the rod being movable in a generally vertical direction upon actuation of the handle; a clip disposed within a groove formed in the rod at a location between an upper end of the rod and a lower end thereof; and a spring disposed between the clip and the door frame, the spring being compressed when the rod is moved in a generally upward, vertical direction. In a fourth example, the door frame includes a bracket having a lip portion and a tab portion, the lip portion being disposed within a first portion of the cavity formed by the first pole and the tab portion being disposed within a second portion of the cavity formed by the second pole.

In a fifth example, the spring is disposed between the tab portion of the bracket and the clip. In a sixth example, the stopper defines a second cavity configured to receive the rod when the handle is not actuated. In a seventh example, a foot portion is coupled to the door, the foot portion including at least one sloped brace, at least one leg, and a passage defined by the foot portion; wherein the at least one sloped brace is disposed within the second pole; wherein the rod is movable through the passage when the release assembly is moved in a vertical direction; wherein the at least one leg is coupled to the stopper. In another example, the stopper includes at least one channel configured to receive the at least one leg of the foot.

In another illustrative embodiment, a pontoon boat comprises: a deck and an interior of the pontoon boat that is located on the deck, the interior including seating for passengers of the pontoon boat; a door movable between a closed position blocking access to the interior and an open position facilitating access to the interior, the door including a door frame; wherein the door further includes a release assembly positioned at least partially within the door frame and movable vertically relative to the door frame from an upper position to a lower position; and wherein when the release assembly is in the lower position and the door is in the closed position the door is not movable to the open position.

In one example of this embodiment, the door frame includes at least a first pole and a second pole, the first and second poles being oriented at an angle relative to one another; wherein the first and second poles define a cavity in which the release assembly moves in and out of as the door moves between the open and closed positions. In a second example, the release assembly includes a handle; a rod coupled to the handle via a threaded nut, the rod being movable in a generally vertical direction upon actuation of the handle; a clip disposed within a groove formed in the rod at a location between an upper end of the rod and a lower end thereof; and a spring disposed between the clip and the door frame, the spring being compressed when the rod is moved in a generally upward, vertical direction.

In a third example, the door frame includes a bracket having a lip portion and a tab portion, the lip portion being disposed within a first portion of the cavity formed by the first pole and the tab portion being disposed within a second portion of the cavity formed by the second pole. In a fourth example, the spring is disposed between the tab portion of the bracket and the clip. In a fifth example, the stopper defines a second cavity configured to receive the rod when the handle is not actuated.

In another example, a foot portion is coupled to the door, the foot portion including at least one sloped brace, at least one leg, and a passage defined by the foot portion; wherein the at least one sloped brace is disposed within the second pole; wherein the rod is movable through the passage when the release assembly is moved in a vertical direction; wherein the at least one leg is coupled to the stopper. In yet another example, the stopper includes at least one channel configured to receive the at least one leg of the foot.

In another illustrative embodiment, a method of operating a door for a pontoon boat to block access to an interior of the pontoon boat comprises: moving a door of the pontoon boat from an open position in which a release assembly of the door is in a lower position, to a partially open position in which the release assembly of the door is in an upper position; moving the door from the partially open position to a closed position in which the release assembly is in the lower position; wherein when the release assembly is in the lower position and the door is in the closed position the door is not movable to the open position; wherein moving the door from the open position to the partially open position includes initiating contact between the release assembly and a stopper fixedly coupled to the deck; and wherein when the door is in the partially open position and when the door is in the closed position access by passengers to the interior of the pontoon boat is blocked by the door.

In one example of this embodiment, the method includes actuating a handle of the release assembly; moving in an upward direction a rod located within a door frame of the door via the actuating step; removing a lower portion of the rod from the stopper; and releasing the door from the closed position to move to the partially open position or the open position.

BRIEF DESCRIPTION OF THE DRAWINGS

The above-mentioned aspects of the present disclosure and the manner of obtaining them will become more apparent and the disclosure itself will be better understood by reference to the following description of the embodiments of the disclosure, taken in conjunction with the accompanying drawings, wherein.

Corresponding reference numerals are used to indicate corresponding parts throughout the several views.

It should be understood that the drawings are not necessarily to scale and that the embodiments are sometimes illustrated by graphic symbols, phantom lines, diagrammatic representations and fragmentary views. In certain instances, details which are not necessary for an understanding of the embodiments described and claimed herein or which render other details difficult to perceive may have been omitted. It should be understood, of course, that the inventions described herein are not necessarily limited to the particular embodiments illustrated. Indeed, it is expected that persons of ordinary skill in the art may devise a number of alternative configurations that are similar and equivalent to the embodiments shown and described herein without departing from the spirit and scope of the claims.

DETAILED DESCRIPTION

The embodiments of the present disclosure described below are not intended to be exhaustive or to limit the disclosure to the precise forms disclosed in the following detailed description. Rather, the embodiments are chosen and described so that others skilled in the art may appreciate and understand the principles and practices of the present disclosure.

Figure 1:
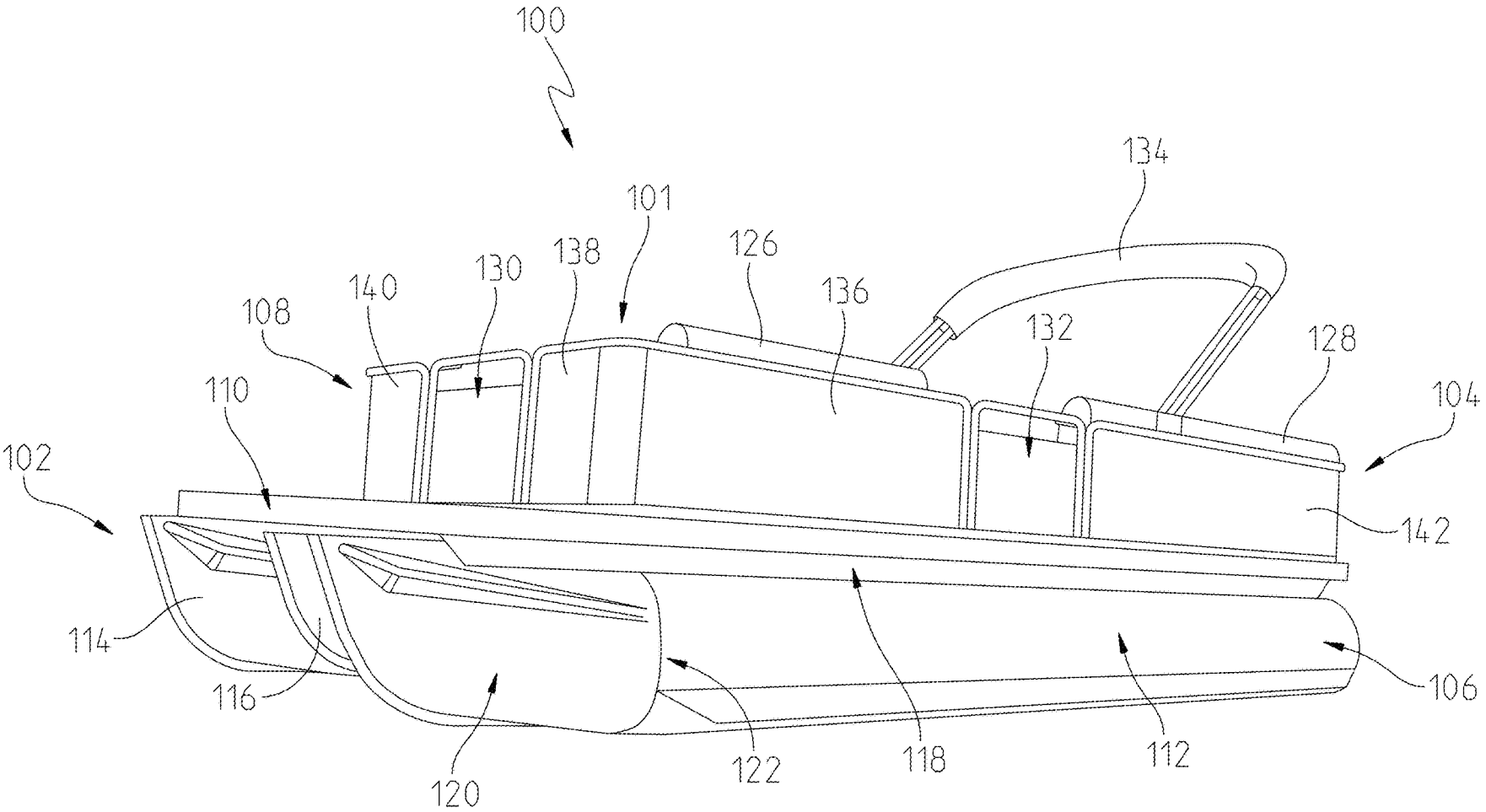
FIG. 1 is a perspective view of a pontoon boat.

Referring to FIG. 1 of the present disclosure, a pontoon boat 100 is illustrated. It should be appreciated that the pontoon boat 100 is an exemplary pontoon boat, and the disclosure herein may apply to pontoon boats having other forms. In the illustrative embodiment, the pontoon boat 100 includes a bow or front end 102, a stern or rear end 104, a port or left side 106, and a starboard or right side 108. The pontoon 100 comprises a deck 110 mounted or otherwise coupled to one or more pontoons. In FIG. 1, for example, the deck 110 is mounted to a first pontoon 112, a second pontoon 114, and a third pontoon 116. In other embodiments, the deck 110 may be mounted to only two pontoons. In yet other embodiments, the deck 110 may be mounted to four or more pontoons. The pontoons may be formed of a metal such as aluminum, and the deck 110 may be form of a marine-grade plywood or composite decking material. In some embodiments, one or more mounting braces 118 may be used for attaching the deck 110 to the pontoons 112, 114, 116.

In the illustrative embodiment, pontoon 112 comprises a nose cone 120 at the front end thereof. It should be appreciated that disclosure regarding the pontoon 112 is equally applicable to the pontoons 114, 116. The nose cone 120 may be seam welded, for example, in a factory to an adjacent cylindrical section of the pontoon 112 as shown in FIG. 1. In the illustrative embodiment, the pontoon 112 has at least three components including the nose cone 120, a number of barrels or substantially cylindrical sections joined by circumferential welds, and an end cap. In some embodiments, the nose cone 120 may comprise two nose cone halves, which are welded together. As shown in FIG. 1, the pontoon boat 100 also includes a bimini 134, which is embodied as a foldable canvas used to shield passengers from rain and sun.

In FIG. 1, the pontoon boat 100 includes a frame 136 that is fixedly coupled to the deck 110. The frame 136 encloses an interior 101 of the pontoon boat 100, which comprises a seating area atop the deck 110 that includes various seating. The frame 136 includes a left front wall 138, a right front wall 140, a left rear wall 142, and a right rear wall (not shown). As shown in FIG. 1, the pontoon boat 100 includes a first arrangement of seating 126 towards the bow 102 and a second arrangement of seating 128 towards the stern 104. In the illustrative embodiment, the pontoon boat 100 includes a door 130 positioned between the left front wall 138 and the right front wall 140. The pontoon boat 100 also includes a door 132 positioned between the left front wall 138 and the left rear wall 142. In other embodiments, other doors may be included as well. Each door 130, 132 is pivotable relative to the frame 136 and the deck 110 for movement between open and closed positions. When the door 130 is in the closed position the door 130 is aligned (e.g., in a straight line with) with the walls 138, 140 of the frame 136, and when the door 130 is in the open position the door 130 is not aligned with the walls 138, 140 of the frame 136. Likewise, when the door 132 is in the closed position the door 132 is aligned (e.g., in a straight line with) with the walls 138, 142 of the frame 136, and when the door 132 is in the open position the door 132 is not aligned with the walls 138, 142 of the frame 136. The doors 130, 132 are substantially the same as one another such that disclosure regarding the door 130 applies equally to the door 132.

Figure 2:
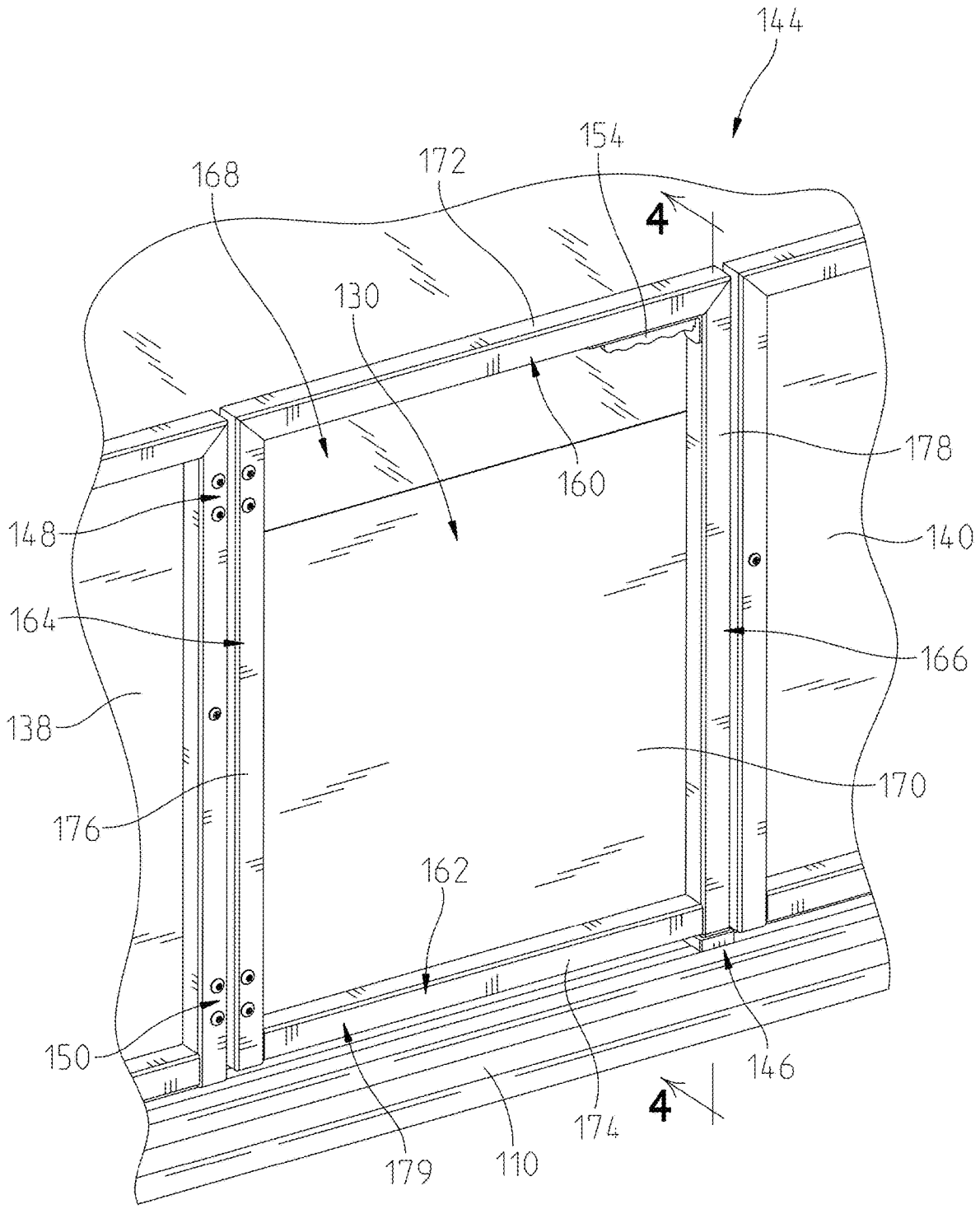
FIG. 2 is a perspective view of a door in a closed position aligned with a frame of the pontoon boat.

As shown in FIG. 2, the door 130 includes a top end 160, a bottom end 162, a left side 164, and right side 166. In the illustrative embodiment, an opening 168 is defined in the door 130 and located between the top end 160 and the bottom end 162. The opening 168 is also located between the left side 164 and the right side 166 of the door 130. In the illustrative embodiment, the door 130 further includes a panel 170 that is located between the top end 160 and the bottom end 162, nearer to the bottom end 162. The panel 170 is also located between the left side 164 and the right side 166 of the door 130. In the illustrative embodiment, the opening 168 is defined between the top portion of the panel 170 and the top end 160 of the door 130. In the illustrative embodiment, the opening 168 provides access to a handle 154 of the door 130 from the interior 101 and an exterior of the pontoon boat 100. In some embodiments, the panel 170 extends the entire length between the bottom end 162 and the top end 160 of the door 130 such that there is no opening between the top portion of the panel 170 and the top end 160 of the door 130. In such embodiments, the handle 154 may be located adjacent to the top portion of the panel 170 (either on the interior or the exterior of the pontoon boat 100) and accessible from the interior 101, the exterior, or both the interior 101 and the exterior, for example, via a user reaching over the top end 160 of the door 130.

The door 130 further includes a plurality of hollow poles 172, 174, 176, 178, which are positioned at the top end 160, bottom end 162, left side 164, and right side 166, respectively, of the door 130. In the illustrative embodiment, an interior of the pole 178 (at the right side 166 of the door 130) is open to an interior of the pole 172 (at the top end 160 of the door) to form a continuous cavity 180 within the poles 172, 178. In the illustrative embodiment, the interior of the pole 178 (at the right side 166 of the door 130) is isolated from an interior of the pole 174 (at the bottom side 162 of the door). The poles 172, 174, 176, 178 are coupled together, and collectively the poles 172, 174, 176, 178 may be referred to as a door frame 179.

Referring still to FIG. 2, a perspective view of a door assembly 144 is shown. In the illustrative embodiment, the door assembly 144 includes the door 130, the left front wall 138, the right front wall 140, the deck 110, and a stopper 146. It should be appreciated that the disclosure herein regarding the door assembly 144 is equally applicable to the door 132 and its adjacent walls 138, 142 as well as other door/frame assemblies for boats.

Figure 3:
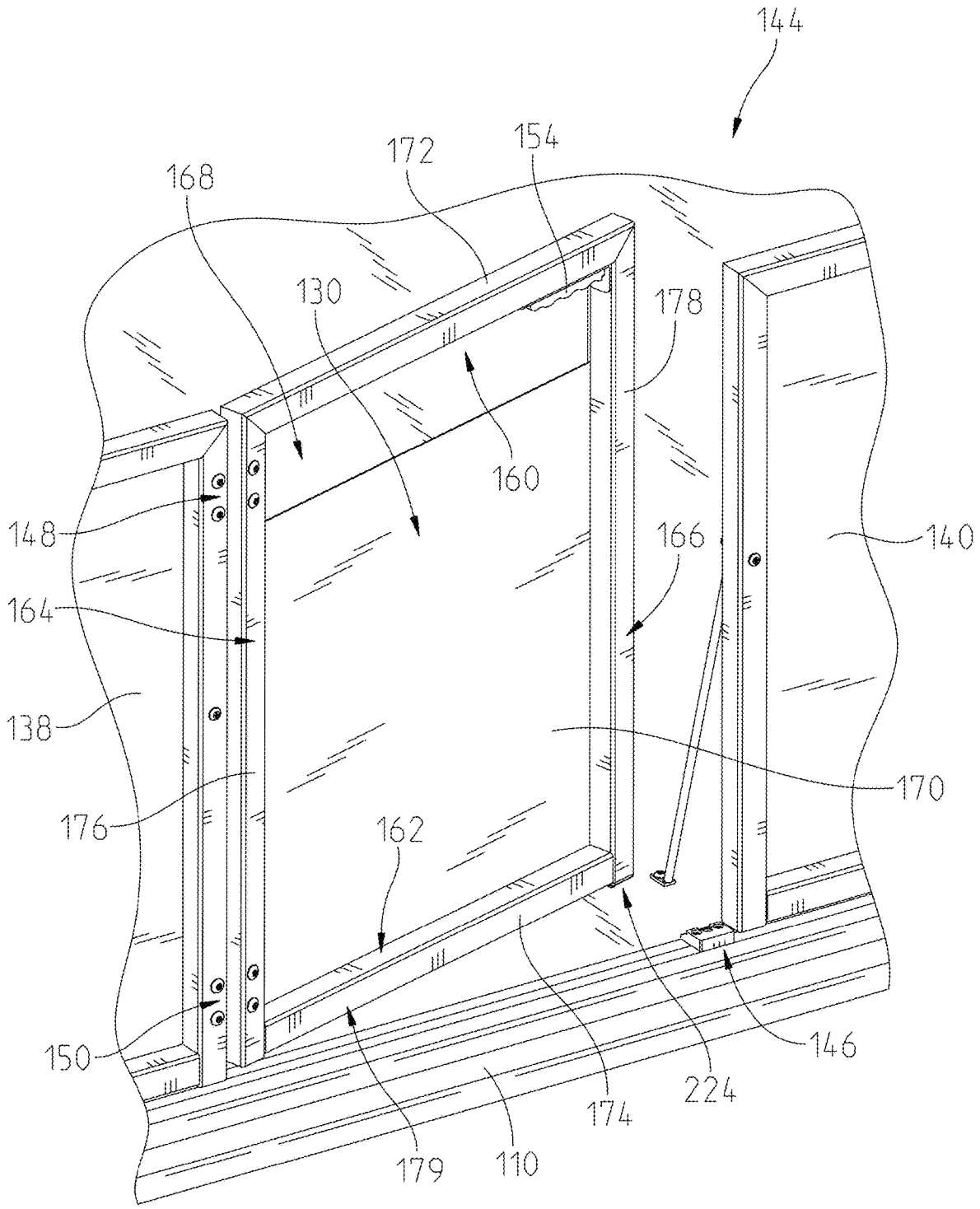
FIG. 3 is a perspective view of the door in an open position not aligned with the frame of the pontoon boat.

In FIG. 2, the door 130 is shown in the closed position, and in FIG. 3 the door 130 is shown in the open position. In the illustrative embodiment, the door 130 is pivotably coupled directly to the frame 136 (e.g., the wall 138), for example, via a hinge assembly having a top hinge 148 and a bottom hinge 150. In other embodiments, the door 130 may be pivotably coupled directly to the deck 110. In the illustrative embodiment, the door 130 pivots outwardly away from the interior 101 of the pontoon boat 100. In some embodiments, the door 130 pivots inwardly toward the interior 101 of the pontoon boat 100. In the illustrative embodiment, the door 130 pivots about an axis of rotation that is substantially perpendicular to the deck 110 and extends through the hinge assembly.

Figure 4:
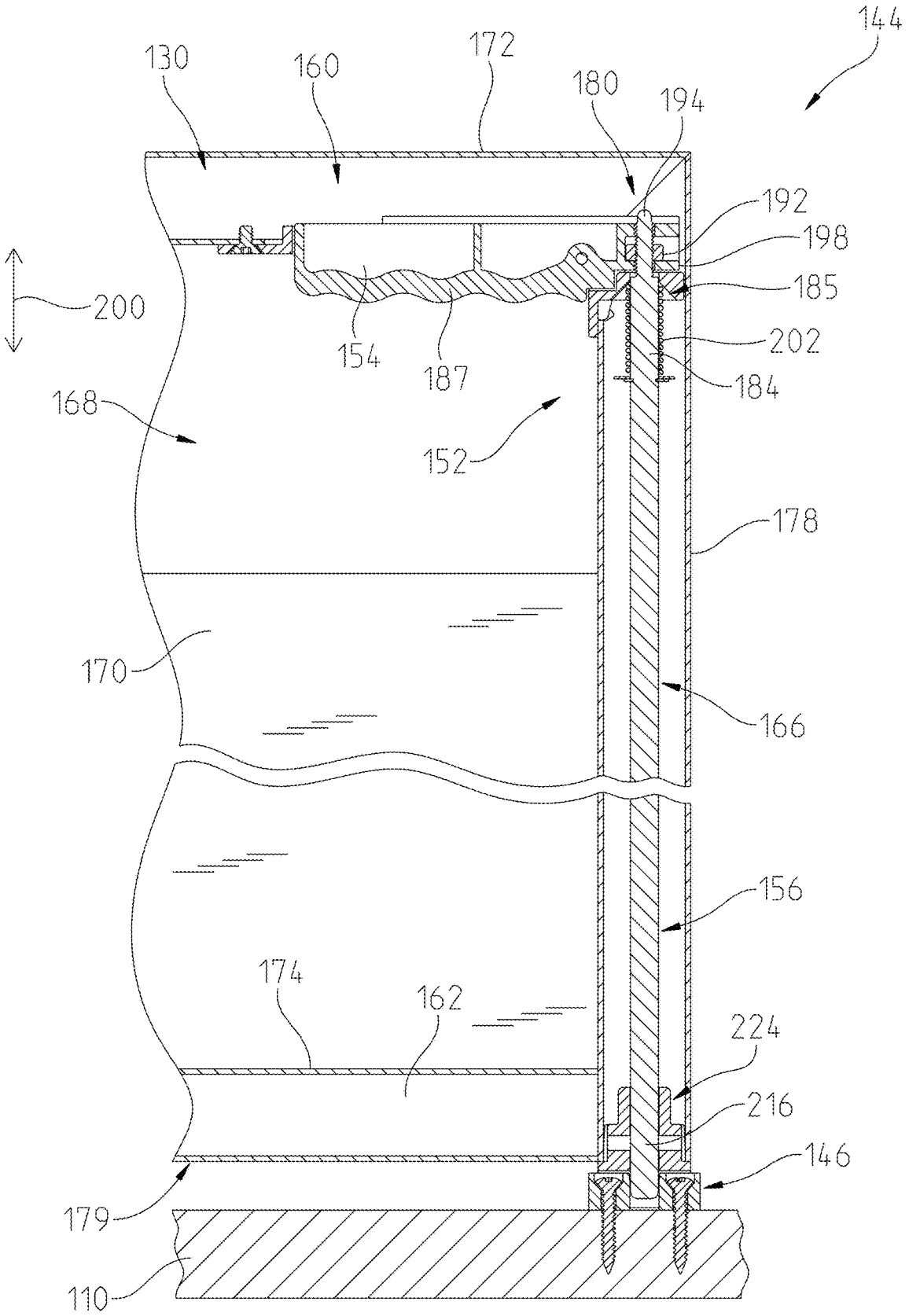
FIG. 4 is a cross section view of a portion of the door showing a release assembly coupled to a deck of the pontoon boat with the door in the closed position.

Referring now to FIGS. 4-7, the door 130 includes a release assembly 152 that is movable in a vertical direction 200 relative to the door frame 179. As shown in FIG. 4, the release assembly 152 includes the handle 154, which is fixedly coupled to a rod 156 for vertical movement therewith relative to the door frame 179.

Figure 5:
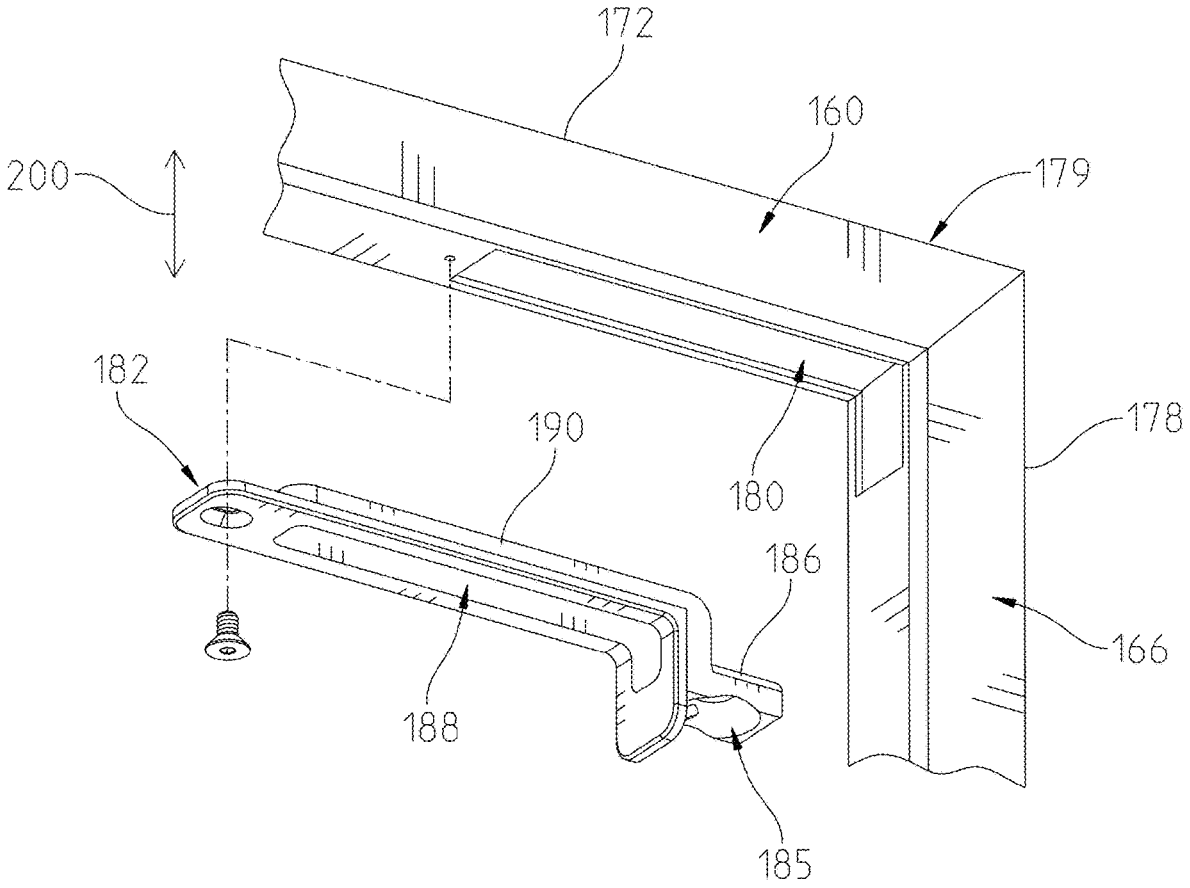
FIG. 5 is an exploded perspective view of a bracket and a top right portion of a door frame of the door.

As shown in FIG. 5, the door 130 includes a bracket 182 fixedly coupled to the door frame 179. In the illustrative embodiment, the bracket 182 is fixedly coupled to the pole 172 via a threaded fastener. Portions of the bracket 182 are positioned in the cavity 180 formed in the poles 172, 178. For example, the bracket 182 includes a top lip 190 positioned in a portion of the cavity 180 that is formed in the pole 172, and the bracket 182 includes a tab 186 that extends away from the top lip 190 and is positioned in a portion of the cavity 180 that is formed in the pole 178. The tab 186 includes an aperture 185 that is sized and shaped to receive an upper portion 184 of the rod 156, which is positioned therein (see FIGS. 4-5). The bracket 182 further includes an elongated slot 188 extending vertically therethrough, which is sized and shaped to receive a grip side 187 of the handle 154, which is positioned therein. The grip side 187 of the handle 154 is movable in the vertical direction 200 relative to the bracket 182 and relative to the door frame 179. In use, an upper portion of the grip side 187 of the handle 154 is moved through the elongated slot 188 of the bracket 182 and into the cavity 180.

Referring again to FIG. 4, the release assembly 152 includes the rod 156, and in the illustrative embodiment, the rod 156 is fixedly coupled to the handle 154 via a threaded nut 192. The threaded nut 192 is secured within a receiving side 198 of the handle 154 (located adjacent to the grip side 187 of the handle 154) and threadingly coupled to a threaded portion 194 of the rod 156. In use, a user may pull upward on the grip side 187 of the handle 154. Upward movement of the handle 154 causes upward movement of the threaded nut 192 secured therein, which pulls the rod 156 upward. In this way, the rod 156 is movable vertically from a lower position to an upper position. It should be appreciated that lower and upper positions of the release assembly 152 (and the other components thereof) correspond to the lower and upper positions of the rod 156.

When the door 130 is in the closed position and the rod 156 is in the lower position, the door 130 is secured in the closed position and cannot be moved to the open position. However, when the door 130 is in the closed position and the rod 156 is in the upper position, the door 130 is freely movable to the open position.

Figure 8:
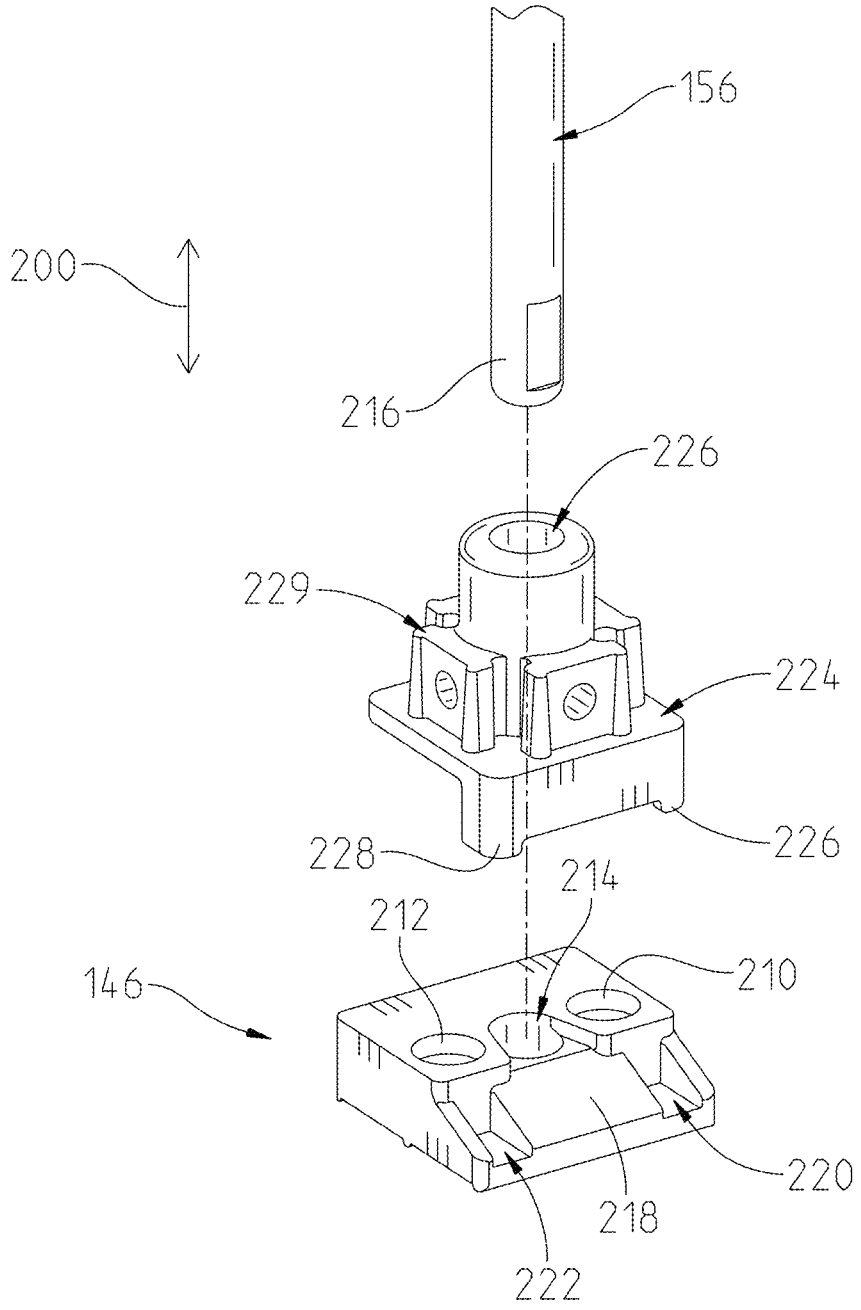
FIG. 8 is an enlarged exploded perspective view of the lower end of the rod, the stopper, and a foot, which is secured to the door frame, and through which the lower end of the rod moves.

As shown in FIGS. 3-4, the stopper 146 is fixedly coupled to the deck 110, for example, by threaded fasteners. The stopper 146 is positioned directly adjacent to the wall 140, aligned therewith, and configured to receive the rod 156 when the door 130 is in the closed position. As shown in FIG. 8, the stopper 146 includes apertures 210, 212 for receiving the threaded fasteners that secure the stopper 146 to the deck 110. In the illustrative The stopper 146 further includes a cavity 214 that is configured to receive a lower end 216 of the rod 156, which is positioned in the cavity 214 when the rod 156 is in the lower position. Referring still FIG. 8, the stopper 146 further includes a ramp 218 sloping upward toward an opening of the cavity 214. The stopper 146 further includes a first channel 220 and a second channel 222 located on opposite sides of the ramp 218.

Referring now to FIGS. 3-4 and 8, the door 130 includes a foot 224 that is fixedly coupled to the door frame 179. In the illustrative embodiment, the foot 224 is fixedly coupled to and positioned within a bottom end of the pole 178. In the illustrative embodiment, the foot 224 includes sloped braces 229 configured to secure the foot 224 within the pole 178. The foot 224 includes a first leg 226 and a second leg 228 spaced apart from one another and each extending downward. In use, when the door 130 is moved to the closed position, the channels 220, 222 are configured to receive the legs 226, 228 respectively. As shown in FIGS. 3-4, the foot 224 includes a passage 226 extending vertically therethrough, which is sized and shaped to receive the lower end 216 of the rod 156. In the illustrative embodiment, the braces 229 surround the passage 226. The rod 156 is movable vertically relative to the foot 224, and as shown in FIG. 4, when the rod 156 is in the lower position the lower end 216 of the rod 156 extends through the passage 226 and below the foot 224.

In use, the door 130 movable is movable to a partially open position, which is between the open position and the closed position. When the door 130 is in the partially open position the lower end 216 of the rod 156 contacts the ramp 218. In use, the door 130 slides up the ramp (causing upward movement of the rod 156), and is subsequently positioned in the cavity 214 (causing downward movement of the rod 156). When the lower end 216 of the rod 156 is positioned in the cavity 214, the door 130 is in the closed position and requires upward movement of the handle 154 before it may be moved to the open position.

Figure 6:
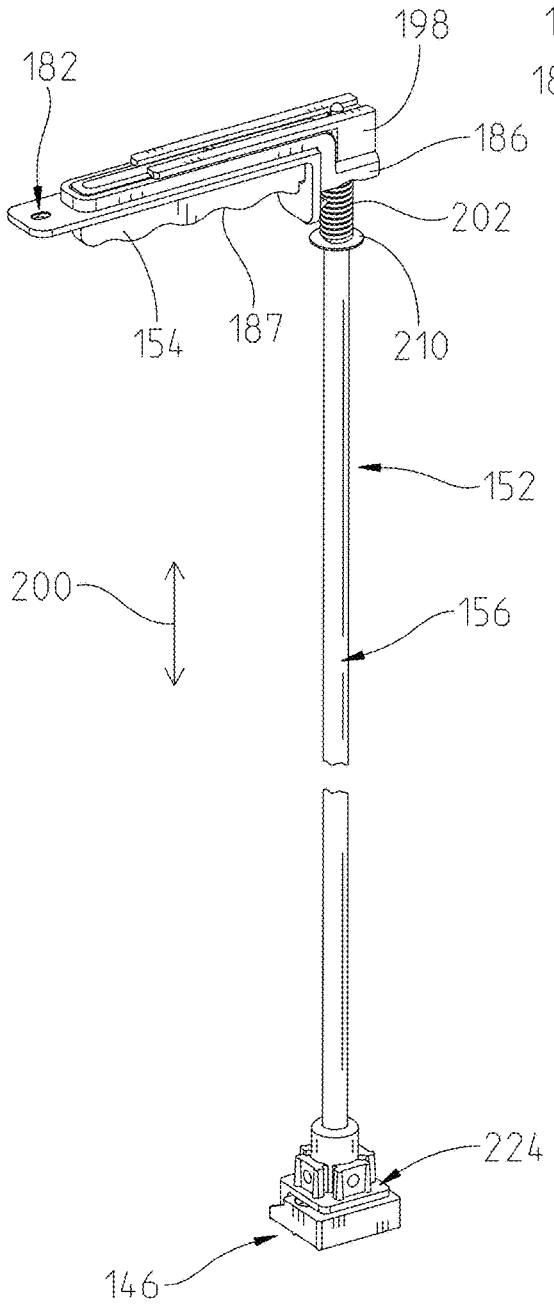
FIG. 6 is perspective view the release assembly, a stopper with a lower end of a rod of the release assembly positioned therein, and the bracket of FIG. 5 through which a handle of the release assembly moves to pull the lower end of the rod upward out of the stopper.
Figure 7:
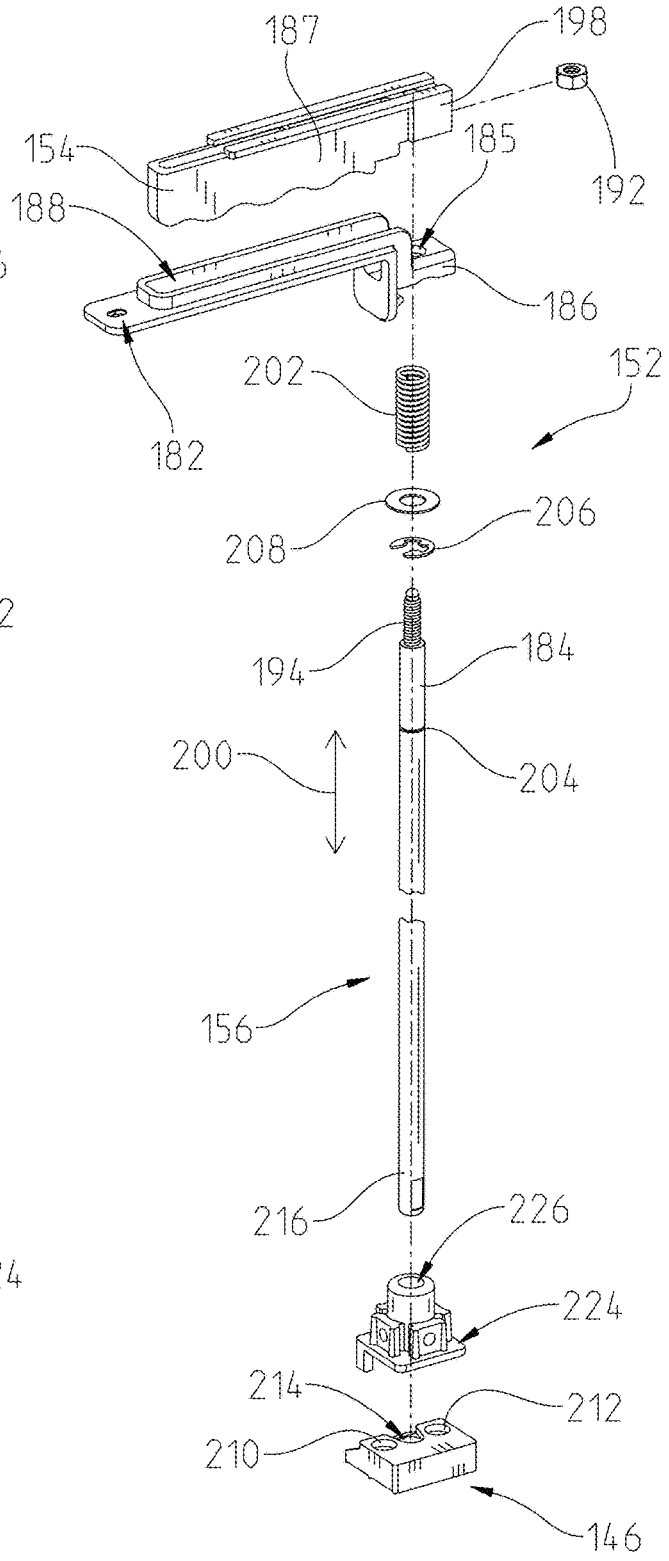
FIG. 7 is an exploded perspective view of the components of FIG. 6.

As shown in FIG. 4, the rod 156 is biased to the lower position via a spring 202 surrounding the upper portion 184 of the rod 156. Referring now to FIGS. 4 and 6-7, the rod 156 includes a circular groove 204 formed therein. In the illustrative embodiment, the groove 204 defines a lowermost location of the upper portion 184 of the rod 156. The release assembly 152 further includes a c-shaped clip 206 secured in the groove 204 and a ring (e.g., a washer) 208 positioned directly above the clip 206 and surrounding a section of the upper portion 184 of the rod 156. The clip 206 prevents downward travel of the ring 208 beyond the clip 206. The spring 202 is compressed between the tab 186 of the bracket 182 and the ring 208 to urge the rod 156 to the lower position. In use, a user applies upward force to the handle 154 to overcome the spring 202 and cause upward movement of the release assembly 152 against the spring 202 such that the door 130 may be moved to the open position.

While exemplary embodiments incorporating the principles of the present disclosure have been disclosed hereinabove, the present disclosure is not limited to the disclosed embodiments. Instead, this application is intended to cover any variations, uses, or adaptations of the disclosure using its general principles. Further, this application is intended to cover such departures from the present disclosure as come within known or customary practice in the art to which this disclosure pertains and which fall within the limits of the appended claims.

The invention claimed is:

1. A pontoon boat comprising:

a frame including a first wall and a second wall spaced apart from the first wall;

a door movable between a closed position in which the door is aligned with the first wall and the second wall and an open position in which the door is not aligned with the first wall and the second wall, the door including a door frame;

a deck relative to which the door is pivotable, the deck supporting the frame;

a stopper fixedly coupled to the deck and configured to receive the door in the closed position;

wherein the door further includes a release assembly positioned at least partially within the door frame and movable vertically relative to the door frame from an upper position to a lower position; and wherein, when the release assembly is in the lower position and the door is in the closed position, the door is not movable to the open position;

wherein the door frame comprises at least a first pole and a second pole, the first and second poles being oriented at an angle relative to one another;

wherein the first and second poles define a cavity in which the release assembly moves in and out of as the door moves between the open and closed positions;

wherein the release assembly comprises:

a handle;

a rod coupled to the handle via a threaded nut, the rod being movable in a generally vertical direction upon actuation of the handle;

a clip disposed within a groove formed in the rod at a location between an upper end of the rod and a lower end thereof; and a spring disposed between the clip and the door frame, the spring being compressed when the rod is moved in a generally upward, vertical direction.

2. The pontoon boat of claim 1, wherein the stopper defines a second cavity configured to receive the rod when the handle is not actuated.

3. The pontoon boat of claim 1, wherein the second pole is oriented in a generally vertical orientation relative to the deck, the second pole being hollow and configured to receive a rod;

wherein the rod is coupled to a handle of the release assembly for movement in a generally vertical direction as the release assembly is moved relative to the door frame.

4. The pontoon boat of claim 3, wherein the rod is coupled to the release assembly via a threaded nut.

5. The pontoon boat of claim 1, wherein the door frame comprises a bracket having a lip portion and a tab portion, the lip portion being disposed within a first portion of the cavity formed by the first pole and the tab portion being disposed within a second portion of the cavity formed by the second pole.

6. The pontoon boat of claim 5, wherein the spring is disposed between the tab portion of the bracket and the clip.

7. The pontoon boat of claim 1, further comprising a foot portion coupled to the door, the foot portion comprising at least one sloped brace, at least one leg, and a passage defined by the foot portion;

wherein the at least one sloped brace is disposed within the second pole;

wherein the rod is movable through the passage when the release assembly is moved in a vertical direction;

wherein the at least one leg is coupled to the stopper.

8. The pontoon boat of claim 7, wherein the stopper comprises at least one channel configured to receive the at least one leg of the foot portion.

9. A pontoon boat comprising:

a deck and an interior of the pontoon boat that is located on the deck, the interior including seating for passengers of the pontoon boat;

a door movable between a closed position blocking access to the interior and an open position facilitating access to the interior, the door including a door frame;

wherein the door further includes a release assembly positioned at least partially within the door frame and movable vertically relative to the door frame from an upper position to a lower position; and wherein, when the release assembly is in the lower position and the door is in the closed position, the door is not movable to the open position;

wherein the door frame comprises at least a first pole and a second pole, the first and second poles being oriented at an angle relative to one another;

wherein the first and second poles define a cavity in which the release assembly moves in and out of as the door moves between the open and closed positions;

wherein the release assembly comprises:

a handle;

a rod coupled to the handle via a threaded nut, the rod being movable in a generally vertical direction upon actuation of the handle;

a clip disposed within a groove formed in the rod at a location between an upper end of the rod and a lower end thereof; and a spring disposed between the clip and the door frame, the spring being compressed when the rod is moved in a generally upward, vertical direction.

10. The pontoon boat of claim 9, wherein the stopper defines a second cavity configured to receive the rod when the handle is not actuated.

11. The pontoon boat of claim 9, wherein the door frame comprises a bracket having a lip portion and a tab portion, the lip portion being disposed within a first portion of the cavity formed by the first pole and the tab portion being disposed within a second portion of the cavity formed by the second pole.

12. The pontoon boat of claim 11, wherein the spring is disposed between the tab portion of the bracket and the clip.

13. The pontoon boat of claim 9, further comprising a foot portion coupled to the door, the foot portion comprising at least one sloped brace, at least one leg, and a passage defined by the foot portion;

wherein the at least one sloped brace is disposed within the second pole;

wherein the rod is movable through the passage when the release assembly is moved in a vertical direction;

wherein the at least one leg is coupled to the stopper.

14. The pontoon boat of claim 13, wherein the stopper comprises at least one channel configured to receive the at least one leg of the foot.

15. A method of operating a door for a pontoon boat to block access to an interior of the pontoon boat, the method comprising:

moving a door of the pontoon boat from an open position in which a release assembly of the door is in a lower position, to a partially open position in which the release assembly of the door is in an upper position;

moving the door from the partially open position to a closed position in which the release assembly is in the lower position;

wherein when the release assembly is in the lower position and the door is in the closed position the door is not movable to the open position;

wherein moving the door from the open position to the partially open position includes initiating contact between the release assembly and a stopper fixedly coupled to the deck; and wherein when the door is in the partially open position and when the door is in the closed position access by passengers to the interior of the pontoon boat is blocked by the door.

16. The method of claim 15, further comprising:

actuating a handle of the release assembly;

moving in an upward direction a rod located within a door frame of the door via the actuating step;

removing a lower portion of the rod from the stopper; and releasing the door from the closed position to move to the partially open position or the open position.

* * * * *